US005287259A

United States Patent [19]

Lautzenheiser

[11] Patent Number: 5,287,259

[45] Date of Patent: Feb. 15, 1994

[54] LIGHT REFLECTOR ASSEMBLY

[75] Inventor: Terry L. Lautzenheiser, Grand Haven, Mich.

[73] Assignee: Lorin Industries, Inc., Muskegon, Mich.

[21] Appl. No.: 810,478

[22] Filed: Dec. 19, 1991

Related U.S. Application Data

[63] Continuation-in-part of Ser. No. 802,007, Nov. 27, 1991, abandoned.

[51] Int. Cl.[5] ..... F21V 7/00; F21V 1/06

[52] U.S. Cl. ..... 362/341; 362/346; 362/352

[58] Field of Search ..... 362/341, 343, 346, 352, 362/360, 367, 441, 442, 450, 453, 455, 348

[56] References Cited

U.S. PATENT DOCUMENTS

| | | | |
|---|---|---|---|
| 240,038 | 4/1881 | Powelson et al. | 362/341 |
| 912,426 | 2/1909 | Sibley | 362/360 |
| 1,248,222 | 11/1917 | Weckesser | 362/341 |
| 1,319,186 | 10/1919 | Spencer | 362/343 |
| 1,363,782 | 12/1920 | Handel | 362/360 |
| 2,049,930 | 8/1936 | Rieu-Sicart . | |
| 2,174,937 | 10/1939 | Dietz | 362/346 |
| 2,179,161 | 11/1939 | Rambusch et al. . | |
| 2,194,431 | 3/1940 | O'Neil | 362/297 |
| 2,242,590 | 5/1941 | Moreau | 362/341 |
| 2,418,131 | 4/1947 | Margolis | 362/346 |
| 3,040,994 | 6/1962 | Anderson et al. | 362/365 |
| 3,662,165 | 5/1972 | Osteen et al. | 362/343 |
| 3,700,882 | 10/1972 | Planchon | 362/348 |
| 3,757,110 | 9/1973 | Soboleski | 362/360 |
| 3,774,995 | 11/1973 | Perret | 362/346 |
| 3,857,030 | 12/1974 | Adam | 362/341 |

(List continued on next page.)

FOREIGN PATENT DOCUMENTS

| | | |
|---|---|---|
| 1031310 | 5/1978 | Canada . |
| 3310862 | 9/1984 | Fed. Rep. of Germany . |
| 3810770 | 10/1988 | Fed. Rep. of Germany . |
| 4930 | of 1902 | United Kingdom . |
| 90241 | 2/1959 | Netherlands . |
| 10892 | of 1913 | United Kingdom . |
| 517777 | 2/1940 | United Kingdom . |

OTHER PUBLICATIONS

A product brochure entitled "Aluminium-Veredlung", dated about Jun. 6, 1990, published by Bander-Streifen-Zuschnitte discloses a reflector.

A product brochure entitled "High Pressure Sodium/-Metal Halide", dated Feb., 1990, published by Day--Brite Lighting discloses a reflector.

*Primary Examiner*—Albert J. Makay
*Assistant Examiner*—Y. Quach
*Attorney, Agent, or Firm*—Price, Heneveld, Cooper, Dewitt & Litton

[57] ABSTRACT

A reflector includes multiple segments that can be interconnected by a flexible extrusion and connected to a top collar to form a reflective shell around a light source. The segments are corrugated for increased strength, the corrugations forming elongate facets characterized by reflective surfaces that reflect light laterally beside the light source as well as downwardly from the light source to minimize light reflected back toward the light source and maximize the service life of the light source. The corrugations add strength and stability to the segments permitting the sheet thickness, overall reflector weight, and cost to be minimized. The segments are preferably formed from a stamped aluminum sheet of about 0.020 inch thickness, and can be pre-or-post anodized to form the reflective surfaces, the pre-anodized surfaces being protected by a polycoat during stamping. Differently shaped segments can be arranged as desired to achieve a desired pattern of reflected light, and differently shaped top collars can be used to adapt the reflector for use on different light sources. The reflector can be shipped in a knocked-down state to minimize space required for shipping or storage, and assembled or repaired on site.

32 Claims, 9 Drawing Sheets

U.S. PATENT DOCUMENTS 4,153,929 5/1979 Laudenschlarger et al. ..... 362/350
4,165,529 8/1979 Hagelthorn ..... 362/352
4,188,657 2/1980 Reibling .
4,229,782 10/1980 Ruud et al. ..... 362/367
4,242,727 12/1980 deVos et al. .
4,245,283 1/1981 Hahlen ..... 362/360
4,285,034 8/1981 Sullivan ..... 362/350
4,293,900 6/1981 Dziubaty .
4,303,971 12/1981 Hogue et al. .
4,319,312 3/1982 deVos et al. .
4,338,655 7/1982 Gulliksen et al. .
4,344,111 8/1982 Ruud et al. ..... 362/346
4,347,554 8/1982 Matsushita ..... 362/350
4,386,392 5/1983 Reibling .
4,404,620 9/1983 Takahashi et al. ..... 362/348
4,453,203 6/1984 Pate ..... 362/431
4,504,894 3/1985 Reibling ..... 362/350
4,507,717 3/1985 Wijbenga ..... 362/304
4,575,783 3/1986 Hammond ..... 362/346
4,575,788 3/1986 Lewin .
4,683,525 7/1987 Camm ..... 362/346
4,729,075 3/1988 Brass ..... 362/342
4,761,721 8/1988 Willing .
4,855,886 8/1989 Eijkelenboom et al. .
4,864,476 9/1989 Lemons et al. ..... 362/348
4,910,853 3/1990 Sawdon ..... 29/283.5

LIGHT REFLECTOR ASSEMBLY

CROSS REFERENCE TO RELATED APPLICATION

This application is a continuation-in-part of prior pending application Ser. No. 07/802,007 filed Nov. 27, 1991 now abandoned.

BACKGROUND OF THE INVENTION

This invention relates to reflectors for luminaires and, in particular, to a reflector assembled from segments.

Reflectors are commonly used to reflect light from a light source. The reflectors focus the reflected light in desired patterns and with desired levels of intensity so that energy costs are minimized while maximum lighting is achieved. Reflectors also serve to protect the light source, with some reflectors providing a protective enclosure to protect the light source from weather, dust, moisture, and the like. Still other reflectors provide a lens or bottom cover that serves to protect the light source from flying objects, and also protect persons therebelow in the event that the light source should break apart.

However, due to their hollow, bulky shape, reflectors typically require specialized equipment for their manufacture, and take up considerable amounts of room after manufacture, making them expensive to manufacture, store or ship. Particularly in industrial-type reflectors where the light sources and associated reflectors are often large, shipping and storage can be a major cost. Further, large reflectors tend to be undesirably heavy as is necessary in order for the components to maintain their shape and provide the desired level of durability in service. However, this increases material costs, shipping costs and makes installation more difficult. Still further, reflectors must be adaptable for use on existing lighting systems to be competitive and to avoid excessive inventory problems.

Thus, a need was apparent for a reflector which provides maximum lighting in desired areas while facilitating manufacture, storage, shipping and installation, and providing commercial levels of durability and protection for the light source.

SUMMARY OF THE INVENTION

Accordingly, the present invention provides a reflector including a plurality of panel-like segments that can be arranged and interconnected to form a hollow shell with an outlet opening, a collar means attached to the segments for positioning and retaining the reflector on a light source, and an interconnecting means for interconnecting the segments. In one form, the invention includes a removable connector that captures flanges on the side edges of the segments so as to orient the segments relative to each other, whereby the reflector can be shipped and stored unassembled, and assembled or repaired on site or as desired. In another form, the invention includes a removable top collar that attaches to flanges on the segments, the top collar being attachable on-site. In yet another form, the invention includes segments having an integral bottom flange adapted to retain a cover over the outlet opening.

Preferably, the segments are stamped from a sheet of anodized aluminum sheet of about 0.020 inch thickness or less, and include corrugations which increase the structural strength of the segments, the corrugations forming facets on the inner reflective surface of the segments that are elongate and distribute the light in selected patterns. Advantageously, the top collars and segments come in different configurations, thus allowing them to be selected on site to give a particular pattern of reflected light or to attach to a particular existing light source structure.

As will be understood from the invention, numerous advantages over the prior known reflectors are provided by this invention. These include increased manufacturability of reflectors due to the relatively flat panel-like shape of the segments. Further, flanges for attachment can be integrally formed on the segments during manufacture. Still further, a variety of different materials can be used to make the segments. Additionally, the inner surface of the segments can be treated to make them reflective either before or after manufacture of the segment. For example, where aluminum is used, the segments can be pre-or-post anodized, with the pre-anodized surfaces being protected by a polycoat or other protective coating during processing. Also, the use of specialized processes for manufacture, such as for making the inner surface reflective after forming the reflector, are minimized.

Concerning assembly, the segments need not be immediately assembled, and can be stored in compact arrangements to conserve space during storage and shipping. Further, later assembly of the reflector parts is simplified. Additionally, reflector parts can be selected as needed for original installation or repair or to give desired patterns of reflected light. Also, the reflector is compatible for use with existing light sources and associated hardware. Overall, the reflector assembly is adaptable to fit various needs while providing a relatively noncomplex yet reliable mechanical structure.

These and other objects, advantages, purposes and features of the invention will become more apparent from a study of the following description taken in conjunction with the drawings.

DETAILED DESCRIPTION OF THE PREFERRED EMBODIMENT

Figure 1:
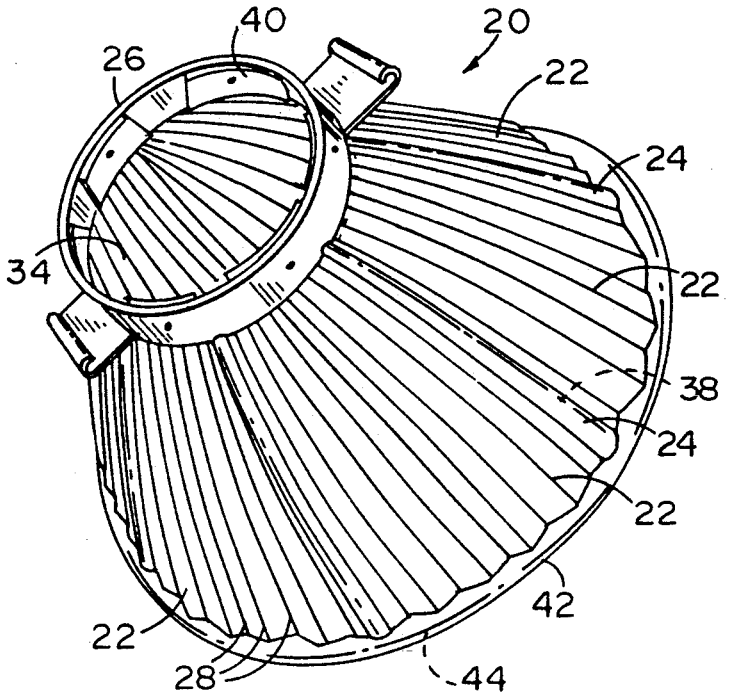
FIG. 1 is a perspective view of a reflector embodying the present invention.
Figure 2:
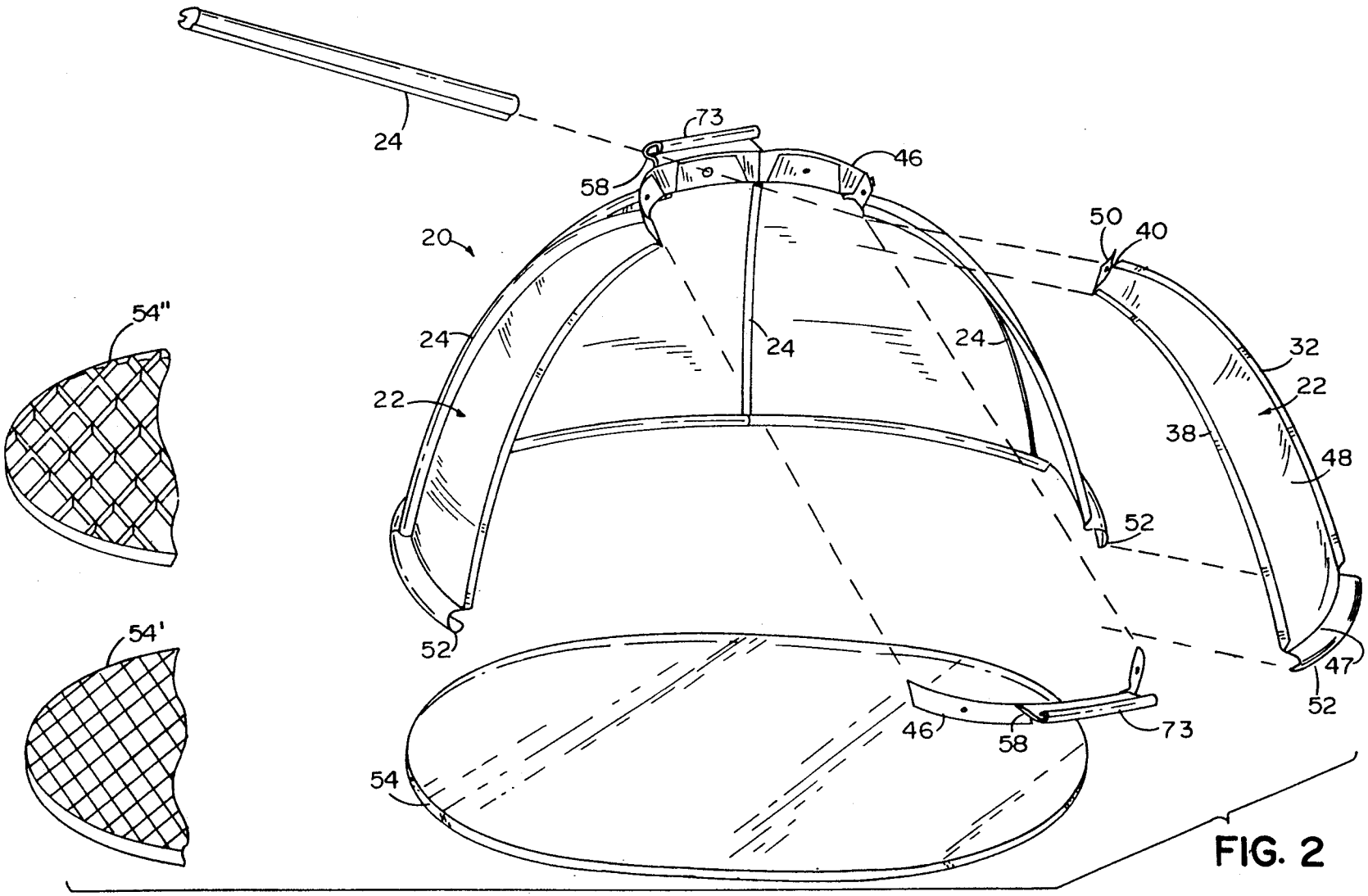
FIG. 2 is an exploded view of a partial assembly of the reflector in FIG. 1.
Figure 4:
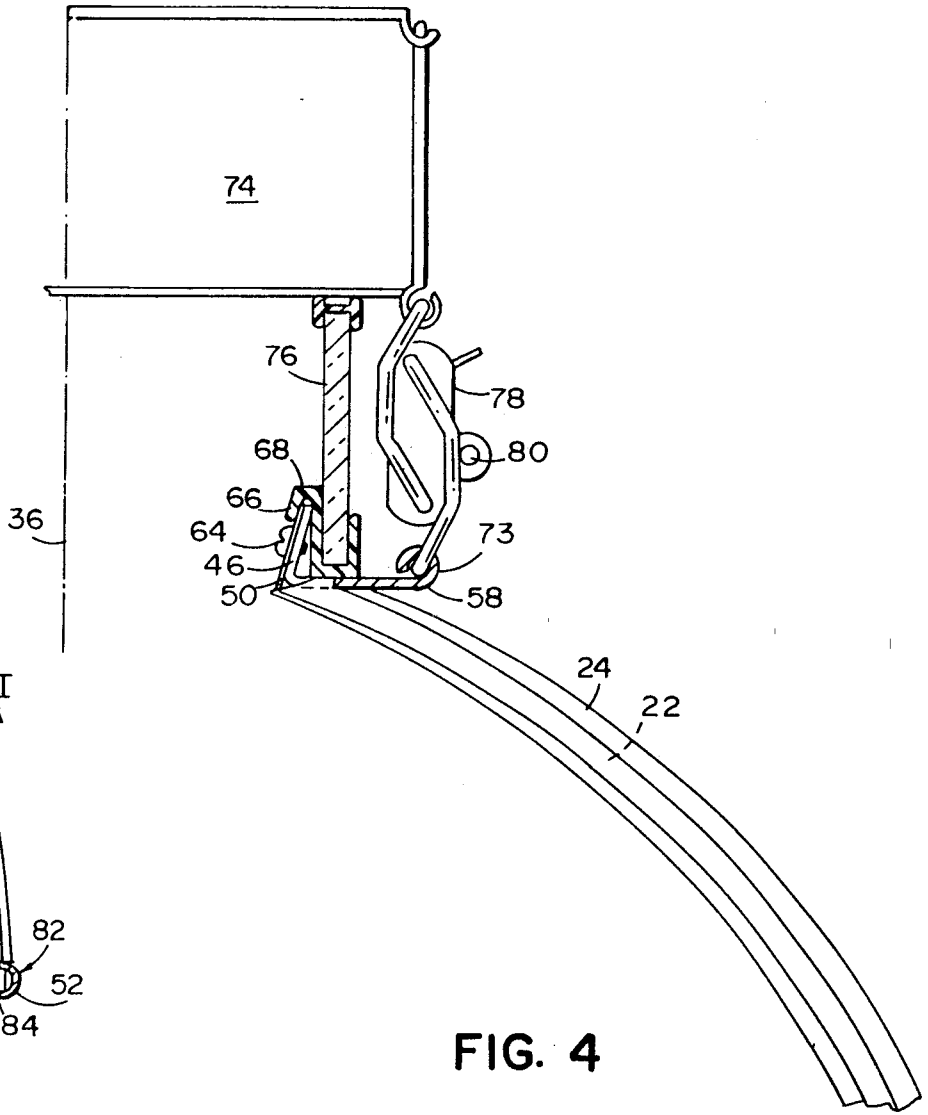
FIG. 4 is an enlarged, side view of the upper portion of FIG. 3.

A reflector embodying the present invention is illustrated in FIGS. 1 and 2 and is generally referred to by numeral 20. Reflector 20 is adapted to be positioned around a light source 32 or 33 (FIG. 3) to form a light weight luminaire. Reflector 20 includes multiple panel-like segments 22 that are interconnected at their adjacent side edges 38 by a removable connector such as flexible extrusion 24 and connected at their top edges 40 to a top collar 26. Segments 22 include a reflective inner surface 34 so that when they are joined, segments 22 form a geometrically shaped hollow and reflective shell around light source 32, with top collar 26 attaching to and holding light source 32 on a central optical axis 36 (FIG. 3) defined by the geometric shell. The bottom edges 42 of segments 22 form an outlet opening or mouth 44 for emitting the direct and reflected light from light source 32.

Figure 7:
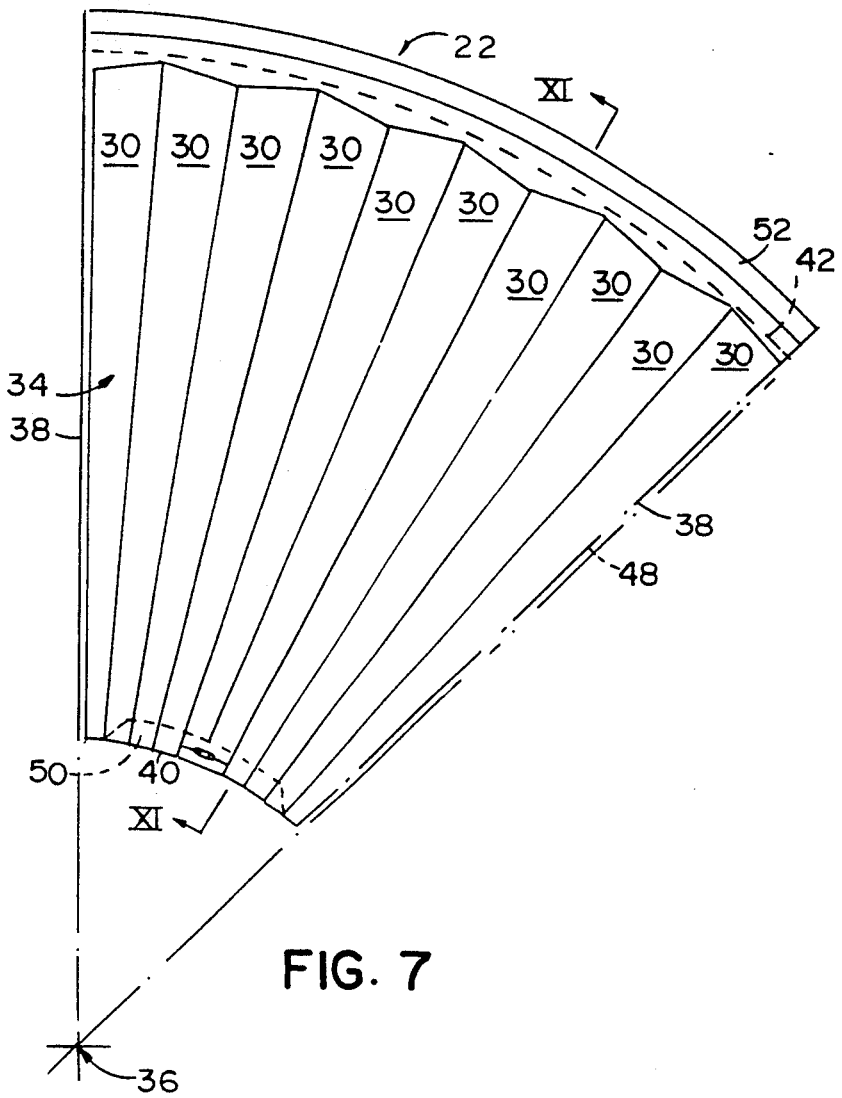
FIG. 7 is a top view of a segment.
Figure 5:
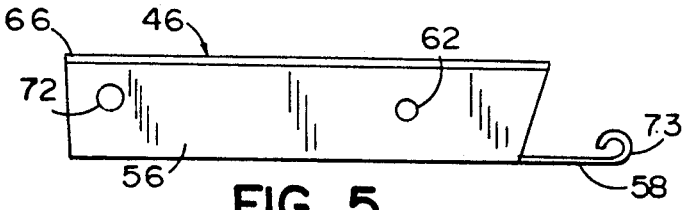
FIG. 5 is a profile view of a top collar half piece.
Figure 6:
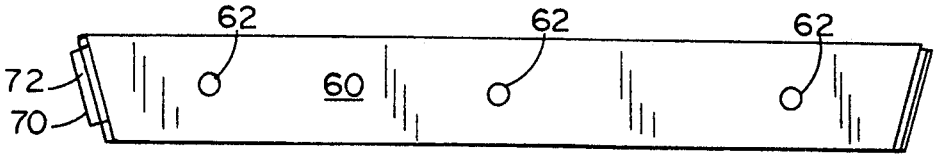
FIG. 6 is a side view of the top collar half piece of FIG. 5.
Figure 9:
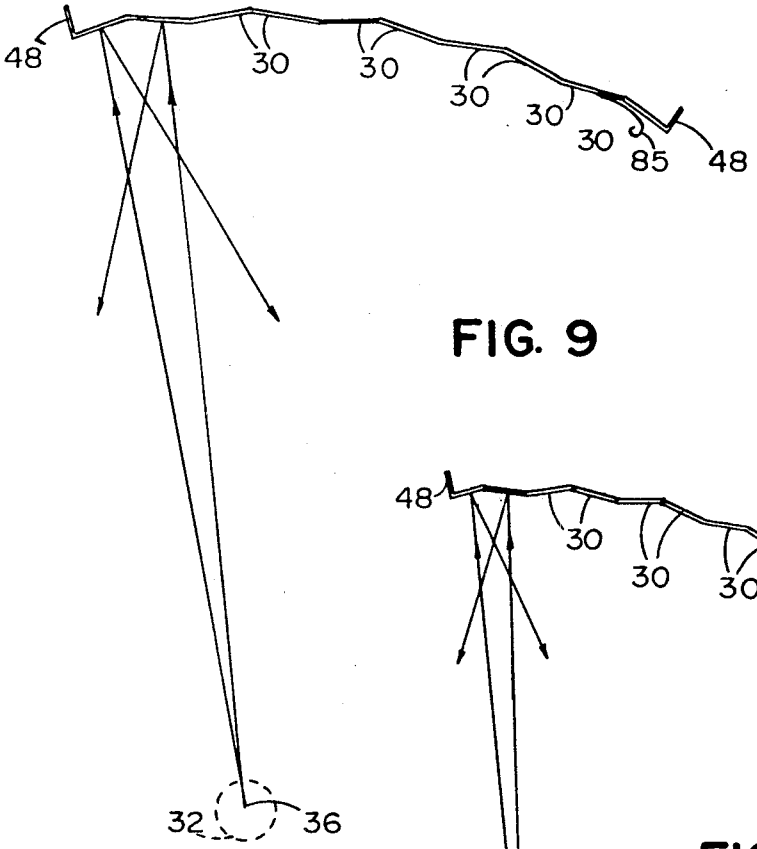
FIG. 9 is a sectional view as taken through plane IX—IX in FIG. 8.
Figure 10:
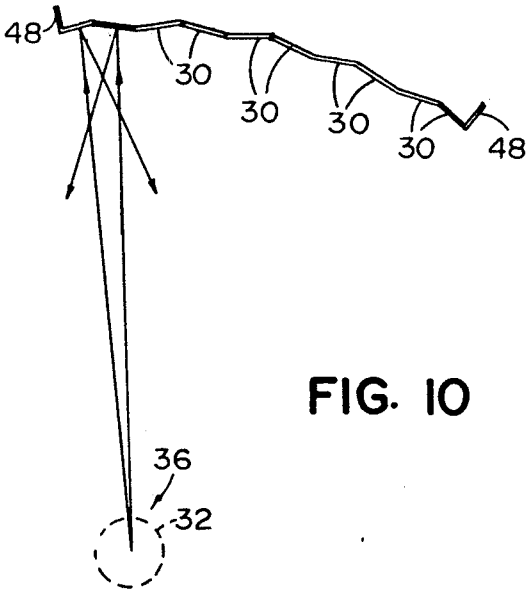
FIG. 10 is a sectional view as taken through plane X—X in FIG. 8.
Figure 8:
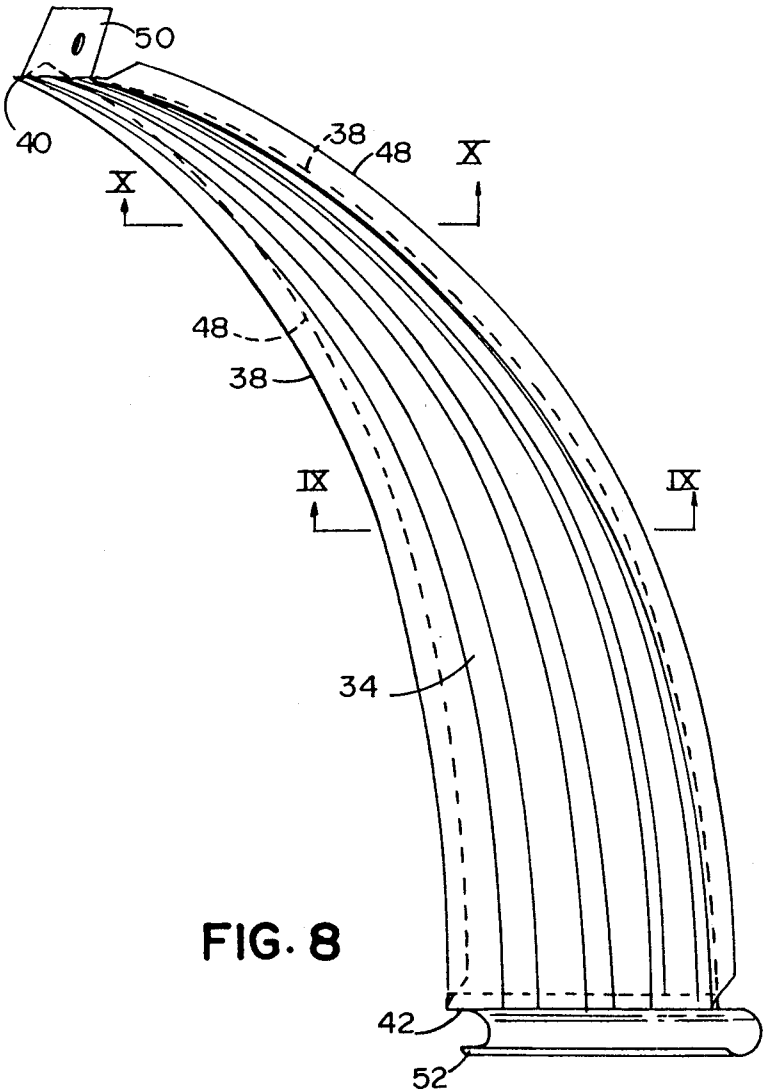
FIG. 8 is a side view of the segment of FIG. 7.

Segments 22 are characterized by folds or corrugations 28 (FIG. 7) that extend vertically along segments 22. Corrugations 28 add strength and structural integrity to segments 22 allowing segments 22 to be made of thinner and lighter weight materials. Corrugations 28 also form elongate facets 30 on reflective inner surface 34, facets 30 being characterized by elongate, wedge-shaped reflective surfaces oriented to reflect light at complex angles beside and below light source 32, but not back at the light source, so as to minimize the light source heat and maximize the service life of the light source.

Figure 3:
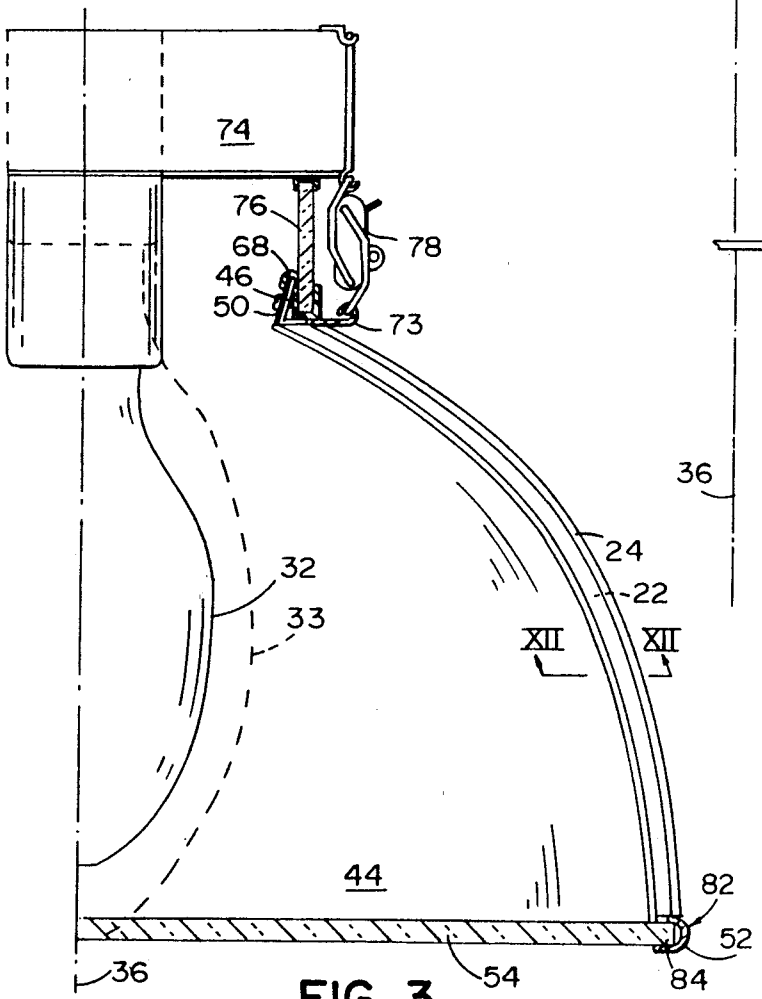
FIG. 3 is a side, sectional view of the reflector in FIG. 1.

A half assembled reflector 20 is illustrated in FIG. 2 with four segments shown as preassembled by extrusions 24 to a top collar half piece 46. For clarity, corrugations 28 are not shown on segments 22 in FIG. 2. As shown, a second top collar half piece 46 is ready to be moved forward and attached to the first top collar half piece 46 to form a complete top collar 26 in the shape of a ring. Also, a segment 22 is shown ready to be moved forward to a position wherein it can be attached to the second top collar half piece 46 and interconnected to adjacent segments by an extrusion 24. Notably, each segment 22 includes integrally formed opposing side edges 38, a top edge 40 and a bottom edge 42 with associated flanges 48, 50 and 52 thereon, respectively. Side edge flanges 48 are adapted for interconnection to adjacent side edge flanges 48 on adjacent segments 22 by extrusion 24, and top edge flange 50 is adapted for attaching to top collar 26. Bottom edge flange 52 could also be adapted to interconnect to each other or connect to a collar, but in the embodiment shown, defines an inwardly facing "C" shape adapted to retainably engage a bottom cover 54 (FIG. 3). Bottom cover 54 is useful such as for protecting light source 32 from flying objects or for enclosing same from weather. It is contemplated that the bottom cover could be of a number of different types such as a wire mesh cover 54', a grate 54", a lens, or other structures particularly adapted for a given use.

As shown in FIGS. 4–6 and 18, each top collar half piece 46 includes an arcuate semicircular portion 56 and an attachment ear 58. Arcuate portion 56 defines an outwardly angled wall having an angled inner surface 60 with spaced holes 62 therein. Holes 62 permit attachment of top edge flanges or tabs 50 on segments 22 to top collar half piece 46 by screw 64. The outermost end of arcuate wall portion 56 includes an offset 70 (FIG. 6 and 18) allowing a pair of half pieces 46 to be attached together to form a single top collar 26 with a substantially continuous inner surface 60. Offset 70 includes a hole 72 that aligns with one of holes 62 in the mating of top collar half pieces 46, thereby permitting conventional interconnection by use of a screw 64 without use of extra unnecessary parts. By being oriented at an angle with respect to central axis 36, arcuate portion 56 increases its resistance to being forced out of round while maintaining the concept of minimizing weight. The angle at which portion 56 is formed also helps prevent withdrawal of tabs 50 should screw 64 loosen or be lost.

Arcuate portion 56 (FIG. 4) also provides a continuous upper surface 66 adapted to sealingly engage a looping S-shaped gasket 68. Attachment ear 58 extends laterally outwardly from the bottom of arcuate portion 56 and includes a C-shaped lip 73 on its outmost end. With this arrangement, top collar 26 is adapted to sealingly engage a light source fixture such as the fixture 74 shown. All of the details of fixture 74 need not be described in detail other than to note that fixture 74 includes a translucent downwardly extending structure 76 that sealingly engages the outer loop in S-shaped gasket 68 and further includes a releasable over-center latch 78 that grips lip 73 on attachment ear 58 to draw top collar 26 (and reflector 20) and gasket 68 upwardly into sealing engagement against light source fixture 74. When access to light source 32 is desired, latch 78 unlatches and drops top collar 26 (and reflector 20) downwardly a few inches so that light source 32 can be laterally accessed from a side, such as for replacement, adjustment or repair. Optionally, latch 78 includes a safety pin 80 so that it cannot be accidentally released.

Bottom lip or flange 52 (FIG. 3) is C-shaped and adapted to received a C-shaped gasket or pad 82. Gasket 82 is cut to length from a C-shaped extrusion that is adapted to snap into flange 52. Bottom cover 54 includes a marginal edge 84 that engages gasket 82 and, in turn, flange 52. Notably, flanges 52 form a closed section that traps and retains bottom cover 54 when segments 22 are assembled into the shape of reflector 20. Also, gasket 82 assists in holding segments 22 in the geometric shape of reflector 20 both by grippingly attaching each of segments 22 to bottom cover 54 but also by the internal strength of gasket 82 as it passes from segment to segment around outlet opening 44.

Segments 22 (FIGS. 7–10) are generally wedge-shaped, panel-like members made from any of a number of different processes and materials, but in the preferred embodiment, are contemplated to be stamped from a sheet of pre-anodized aluminum of about 0.020 thickness. Alternately, segments 22 can be formed from molded plastic which is sputter coated, polished or plated to form a reflective surface, various other types of metal which may have electrodeposited reflective coatings thereon, or perforated materials which, as explained below allow light distribution to the sides of the reflector.

A sheet of raw aluminum or steel material with a particular reflective surface 34 is selected as desired with a particular diffusion property, the reflective surface 34 including a polycoat 85 (FIG. 9) or other protective coating that adheringly covers and protects the reflective surface 34 from adverse localized damage during the stamping process but which can be later removed or peeled off to expose the reflective surface when the segments are ready for assembly and use. Alternatively, depending upon the characteristics of the sheet to be formed and the size and shape of the segment 22 to be formed, reflective surface 34 need not be covered by polycoat 85. Presently it is contemplated that the preferred embodiment will likely be made of a sheet of pre-anodized aluminum having optical properties of a minimum total reflectance of about 75% to 86%, while also having mechanical properties of an ultimate strength of about 25 to 27 KSI, a yield strength of about 22 to 24 KSI, and an elongation percent of about 5-8%. However, while use of such a sheet is thought to be preferable, it is contemplated that the invention is not limited to any particular sheet or range of properties.

Figure 11:
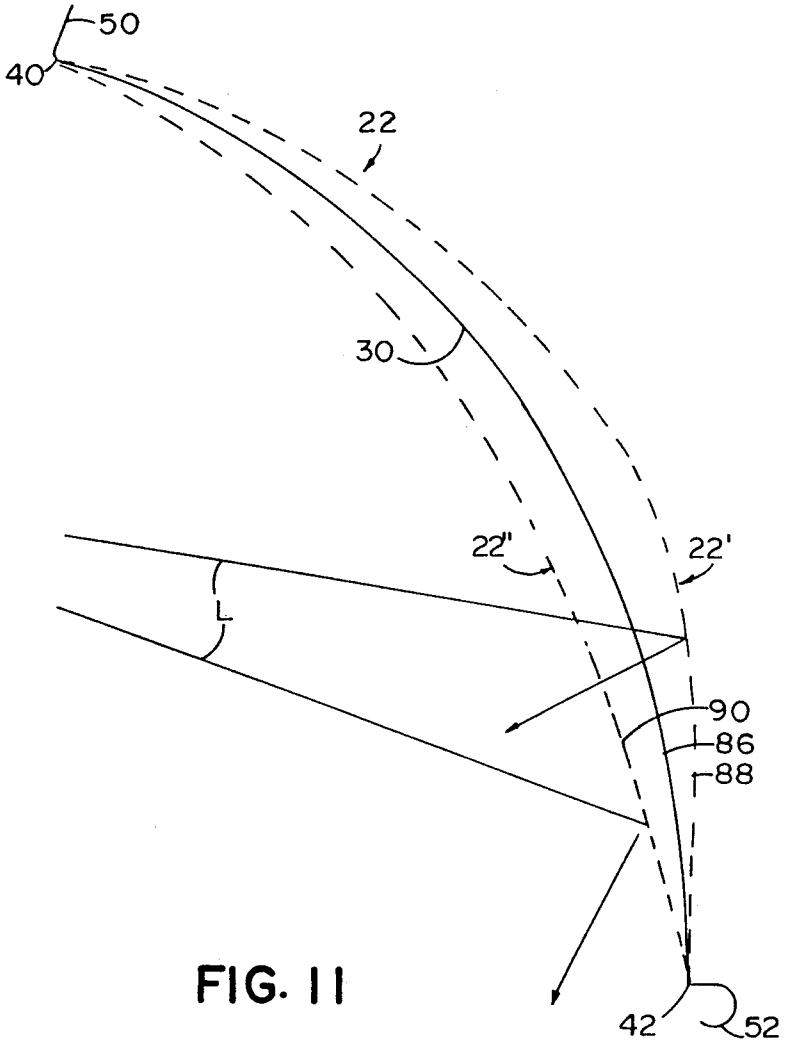
FIG. 11 is a sectional view taken along plane XI—XI in FIG. 7.

As seen in FIGS. 7-11 and the sections taken through them, elongate facets 30 each define a surface that is substantially linear in a transverse or lateral or radial direction about central axis 36 (FIGS. 9-10), but which is curvilinear or arcuate in a longitudinal or axial direction (FIG. 11). Concerning the transverse direction (FIG. 9-10), facets 30 are oriented so that light emitted from light source 32 reflects to one side of central axis 36 and light source 32, with adjacent facets reflecting light on opposite sides of central axis 36 and light source 32. Concerning the axial direction, facets 30 can be any of a number of different shapes as desired to yield the desired pattern of reflected light therebelow.

In the preferred embodiment, facets 30 substantially form a particular shape 86 (FIG. 11) to create a desired distribution of light. It is contemplated that light source 32 will be located within reflector 20 at a location along central optical axis 36 of reflector 20, axis 36 passing through the center of reflector 20 and perpendicularly to the plane occupied by forward opening 44, so that the particular desired distribution of light is obtained. Also, it is contemplated that light source 32 will be a high intensity discharge (HID) lamp such as mercury, high pressure sodium, or metal halide since these light sources are highly efficient and offer long service life, although reflector 20 is suitable for use with other types of light sources.

Figure 17:
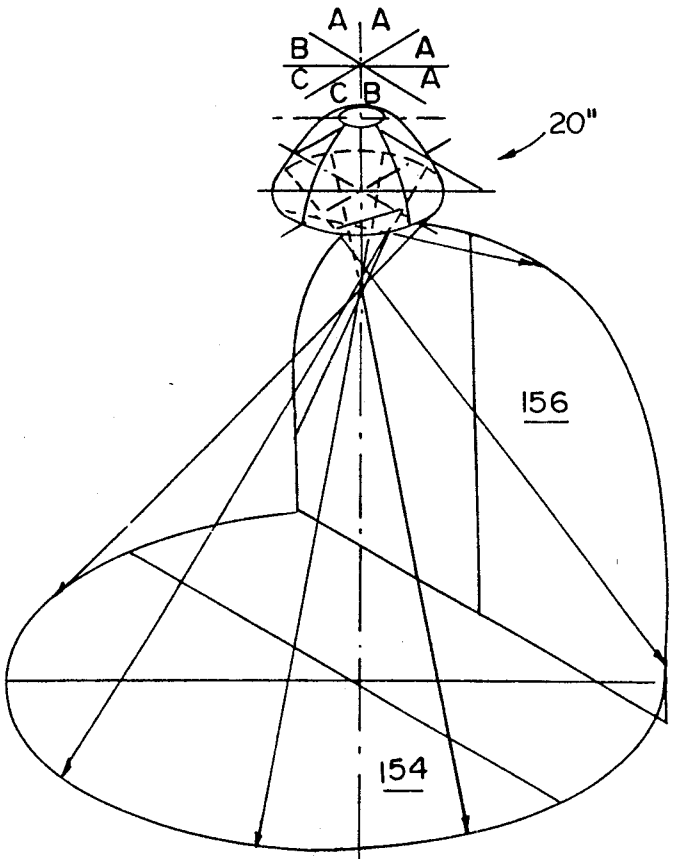
FIG. 17 illustrates yet another form of the reflector providing a third pattern of reflected light.
Figure 16:
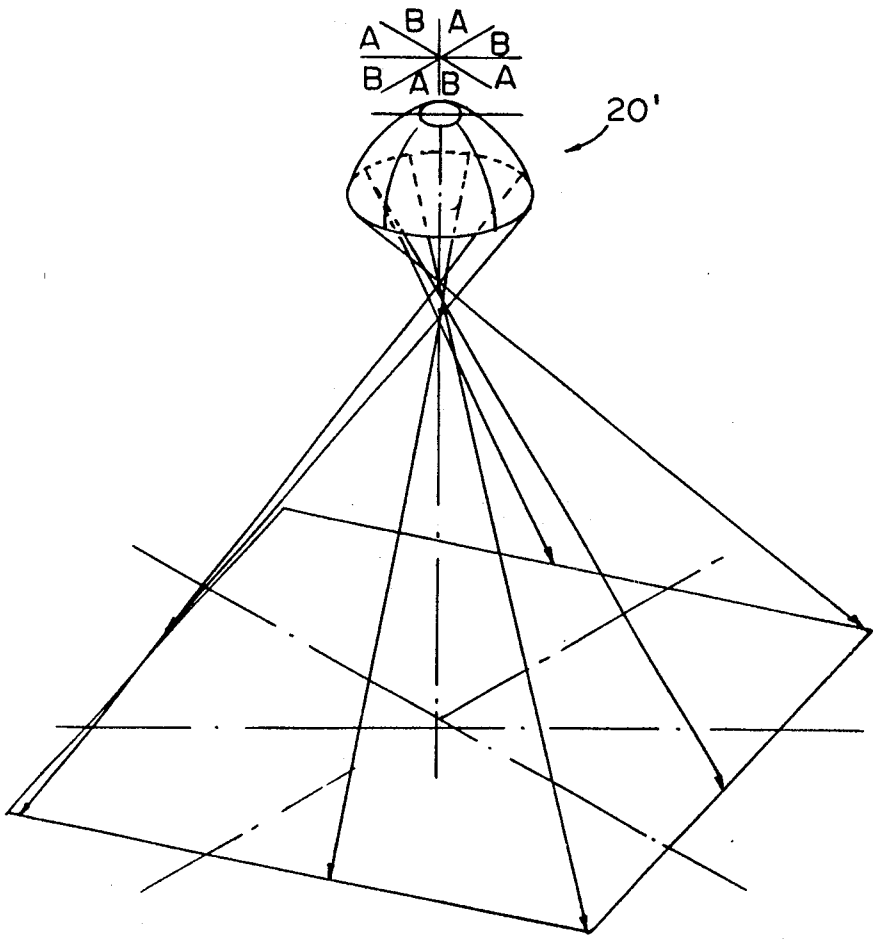
FIG. 16 illustrates another form of the reflector providing a second particular pattern of reflected light.

Also shown in FIG. 11 are two additional axial shapes, a second shape 88 being more sharply curved than shape 86 and useful for reflecting light "L" in a sharply lateral direction, and a third shape 90 that is less sharply curved than shape 86 and useful for reflecting light "L" in a different pattern. Though only three variations in axial shape are shown, a multitude of such shapes are possible. Further, by combining different segments, such as segment 22' with an axial shape 86 near its side edges 38 and with an axially more sharply curved shape 88 near its center, segment 22' reflects at least part of the light laterally, such as against a wall or stack of racks (FIG. 17). Alternatively, by forming a single segment 22'' with an axially less sharply curved shape 90, segment 22'' reflects a particular desired pattern of light therebelow, such as could be used to form a square light pattern (FIG. 16).

Figure 12:
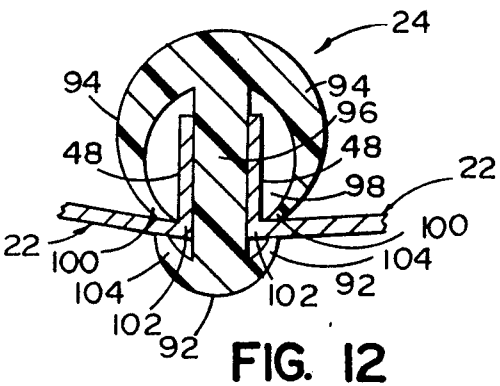
FIG. 12 is an enlarged sectional view taken along plane XII—XII in FIG. 3.
Figure 18:
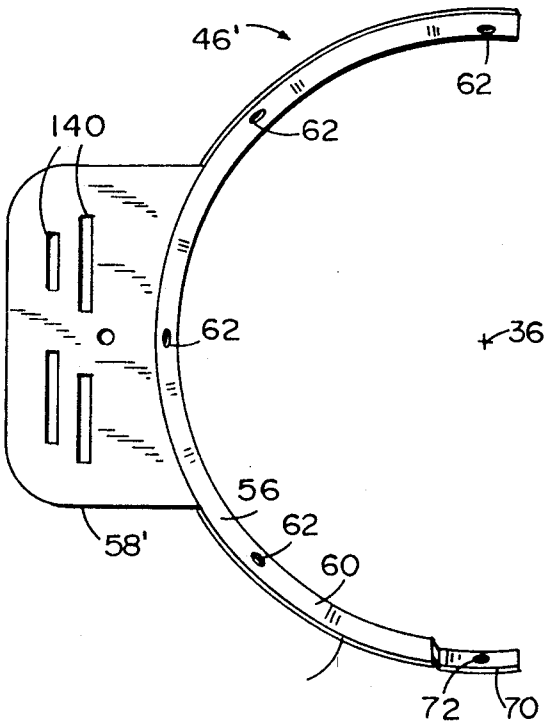
FIG. 18 is a top view of a second embodiment of a top collar half member embodying the present invention.

Extrusion 24 (FIG. 12) is adapted to retainably engage side edge flanges 48 of adjacently positioned segments 22. Extrusion 24 is flexible, elongate and includes inner and outer pairs of opposing lips or resilient flanges 92 and 94, respectively. Resilient flanges 92 and 94 are interconnected by a stem 96. Side edge flanges 48 of segments 22 abut the side surfaces of stem 96 and are captured within the space 98 defined by stem 96 and resilient flanges 92, 94. The outer resilient flanges 94 include a tip 100 that extends substantially into the corner formed at the base 102 of side edge flange 48, thereby trapping and securely retainably engaging same in place against stem 96 and against the opposing tip 104 of inner resilient flange 92.

It is contemplated that extrusion 24 will extend the length of segments 22 and sealingly retain same to each other, though it need not extend the full length thereof or sealingly engage segments 22. Optimally, extrusion 24 will be made of a UV stable material such as a thermoformable extrudable plastic or polymeric material such as polyvinyl chloride (PVC). In the preferred embodiment, extrusion 24 is contemplated to be translucent so as to emit an amount of light therethrough to provide an appearance signature. Extrusion 24 will be resiliently flexible enough to removably slip or slide longitudinally onto side edge flange 48. Alternatively, extrusion 24 could clamp or snap onto side edge flange 48 from a side thereof. For example, it is contemplated that a sheet metal spring-like clip in the shape of a "W" or "C" could be utilized to clamp flanges 48 together.

Figure 13:
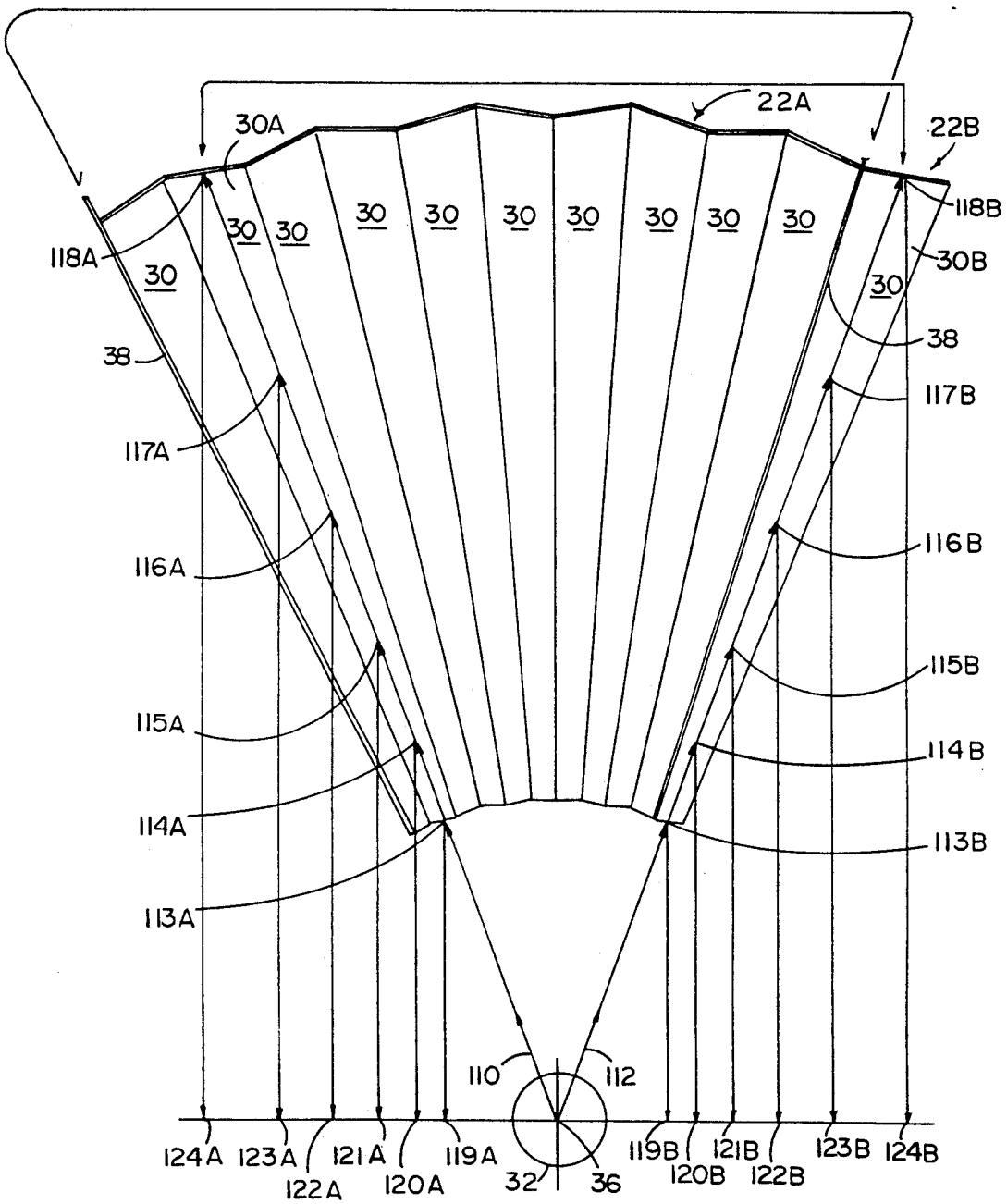
FIG. 13 is a bottom view of a segment showing the distribution of light rays.

FIG. 13 illustrates a light ray trace of the preferred embodiment of reflector 20 from a top view. Two major groups of light rays 110, 112 are shown, with several other groups shown only in an abbreviated form. Group 110 is shown emitting from light source 32 and is shown, for illustration purposes, as striking a particular elongate facet 30A on segment 22A in five locations labelled as locations 113A-118A. As shown, the light is reflected in parallel directions through locations 119A-124A, none of which are on central axis 36 or pass through light source 32, and all of which are on the same side of light source 32. Optionally, a second corresponding facet on an adjacent segment 22B referred to here for clarity as facet 30B reflects light similar to facet 30A, but on an opposite side of light source 32, points 119B-124B corresponding to points 113B-118B. Notably, facet 30A is the second facet in from side edge 38 on first segment 22A, while facet 30B is the first facet in from side edge 38 of the far but adjacent segment 22B. Thus, considering reflector 20 as a whole, an equal amount of light is distributed around light source 32, but substantially none is reflected directly back through light source 32.

Figure 14:
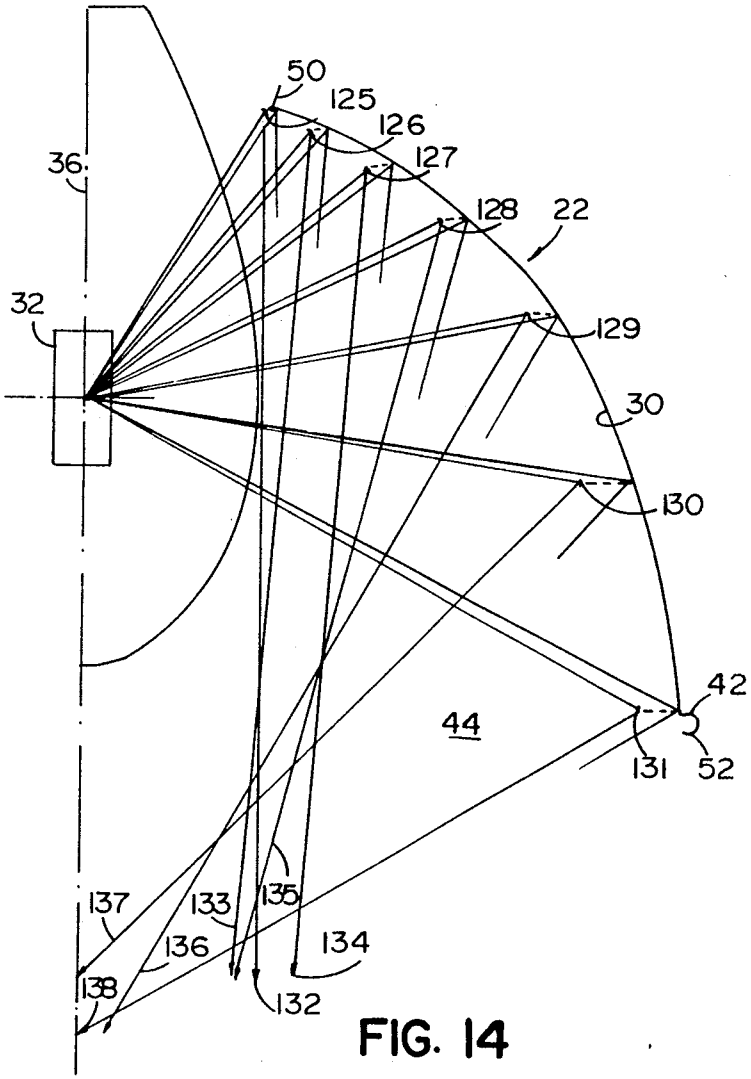
FIG. 14 is a side view of a segment showing the distribution of light rays.

FIG. 14 illustrates a light ray trace of the preferred embodiment of reflector 20 from a side view. Light is emitted from light source 32 and contacts the reflective inner surface of segments 22, such as on the illustrated facet 30. Depending upon the curvature of facet 30, light is reflected generally downwardly toward outlet opening 44 in a complex pattern. Notably, the diffusion and other reflective properties of facets 30 affect this distribution, however the diagram still illustrates the distribution. The particular view shown shows light reflecting at points 125-131 toward locations 132-138. The cumulation of the reflected light gives a particular pattern on the floor therebelow.

Reflector 20 is adapted to be shipped in a knocked down state and assembled on site. As a result, reflector 20 is particularly adapted to be custom built for particular situations. Three such situations are shown in FIGS.

Figure 15:
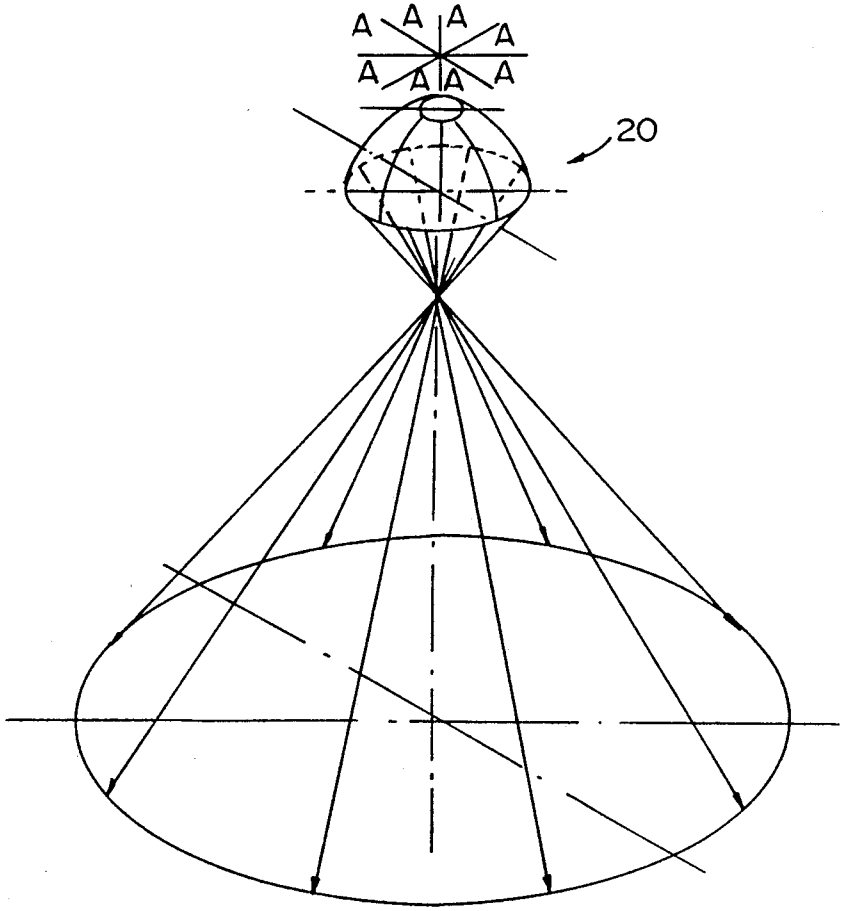
FIG. 15 illustrates one form of the reflector providing a first pattern of reflected light.

15–17, wherein a circular floor pattern of reflected light is desired (FIG. 15), a square or rectangular pattern is desired (FIG. 16), or an asymmetric pattern is desired (FIG. 17). In FIG. 15, a single type segment "A" such as a segment 22 is utilized, eight of segments "A" making a reflector 20. In FIG. 16, two different types of segments "A" and "B" are used in an alternative arrangement to construct reflector 20', such as could be done by alternatingly connecting segments 22 having a particular shape 86 with segments 22' (FIG. 11) having a different shape 88. In FIG. 17, three different types of segments "A", "B" and "C" are used to construct a reflector 20" including, in sequence, four of segment "A", one of segment "B", two of a segment "C" and one more of segment "B". In this last example, segment "C" could be segment 22" (FIG. 11). The reflector formed is generally referred to as 20", and would be useful for lighting both a floor area 154 and a wall of racks or shelves 156.

Reflector 20 can be assembled in a variety of different ways, only one of which is hereinafter described. The desired number of segments 22 (or 22' or 22") are selected along with two top collar half pieces 46, extrusions 24, and bottom cover or grate 54 (such as in FIG. 2) to form the desired reflector 20 which will yield the desired pattern of reflected light and also which will attach to the existing light source fixture 74 (if present). Segments 22 are interconnected by slideably installing extrusion 24 onto adjacent side edge flanges 48 to form a hollow shell with reflective inner surface 34. If desired, a bottom cover or grate 54 is inserted into bottom gasket 82 and, in turn, into bottom flanges 52 as segments 22 are interconnected. Top collar half pieces 46 are attached together to form a ring-like top collar 26 around segment top flanges 50 and attached to same by screws 64. Reflector 20 is then coupled to a light source such as by connecting ears 58 to an over-center latch 78 on an existing light source fixture 74. If desired, an upper gasket 68 can be utilized on top collar 26 to sealingly engage fixture 74, thus providing with bottom cover 54 a substantially weather resistant and air tight enclosure around light source 32.

In use, light source 32 emits light which emanates outwardly and is reflected from elongate facets 30 on reflective inner surface 34 of reflector 20. The facets 30 reflect light downwardly in the desired pattern, but also reflect the light beside and away from light source 32 to minimize heat buildup in light source 32 and maximize its service life.

A plurality of top collars can be made to adapt to different existing light source fixtures. Top collar half piece 46' (FIG. 18) illustrates one such variation which is similar to top collar half piece 46 but includes an attachment flange or ear 58' that extends laterally and is planar in shape. Ear 58' includes multiple slots 140 that permit its attachment to light source fixtures (not shown) having downwardly oriented screws or holes for screws.

Figure 19:
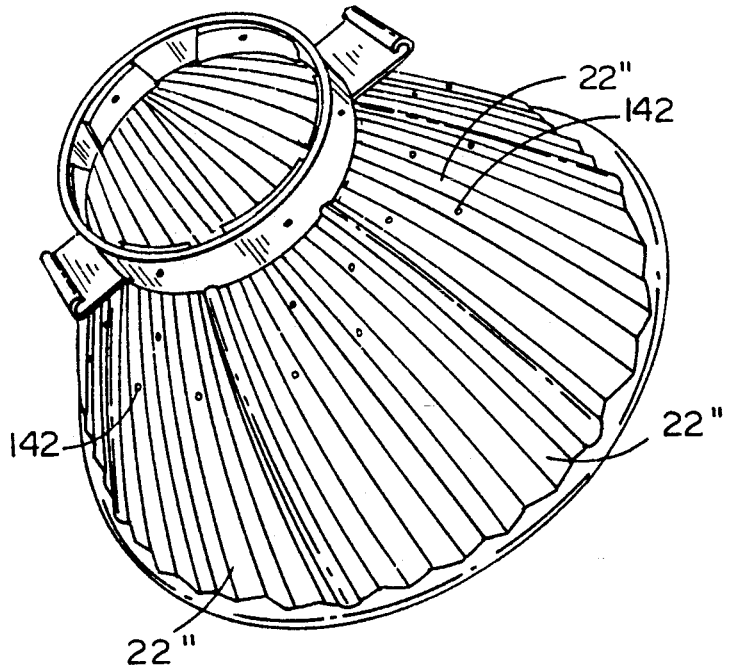
FIG. 19 is a perspective view of a reflector including a second embodiment of a segment embodying the present invention.

It is also contemplated that a reflector could be further modified to distribute light around and outwardly to the sides of the light source fixture to which it is attached, such as by including perforations 142 in segments 22" (FIG. 19).

It is also contemplated that the segments 22 of a reflector could be interconnected or connected to top collar 26 with a fastenerless connection means to further reduce weight and reduce parts required for assembly. One such interconnection is a clinched joint such as is illustrated in U.S. Pat. No. 4,910,853 issued to Sawdon on Mar. 27, 1990 entitled APPARATUS FOR JOINING SHEET MATERIAL, the entire contents of which are incorporated herein by reference.

Thus, a reflector is provided that is made of interconnectable segments. The segments provide increased manufacturability, assemblability and also provide for more efficient storage and shipping. Further, the segments can be shipped in a knocked-down state and assembled on site, the segments and top collar being selected to form a reflector that yields a desired light pattern and also is attachable to existing light fixtures.

While several forms of the invention have been shown and described, other forms will now be apparent to those skilled in the art. Therefore, it will be understood that the embodiment shown in the drawings and described above are merely for illustrative purposes, and are not intended to limit the scope of the invention which is defined by the claims which follow and as interpreted by the Doctrine of Equivalents.

The embodiments of the invention in which an exclusive property or privilege is claimed are defined as follows:

1. A reflector for a luminaire, comprising:

a plurality of segments each having side edges with flanges thereon, a top edge with a flange thereon, a bottom edge, and a reflective inner surface, said plurality of segments being arranged to form a geometrically shaped hollow shell with said bottom edges arranged to form an outlet opening at one end for emitting light therethrough, said geometrically-shaped hollow shell defining a central axis;

collar means for positioning and retaining said reflector to a light source on said central axis relative to said reflective inner surfaces, said collar means attaching to said flanges of said top edges; and interconnecting means for interconnecting said flanges of said side edges, said interconnecting means including a plurality of extrusions each removably engaging the opposing flanges on adjacent side edges of said segments to retain said segments against said connector so as to orient said reflective inner surfaces of said segments relative to each other, whereby said plurality of segments can be shipped and stored in an unassembled state and assembled and repaired on site.

2. The reflector as set forth in claim 1 wherein said interconnecting means slideably installs onto said opposite flanges from an end of said opposite flanges.

3. The reflector as set forth in claim 1 wherein said extrusion includes inner and outer pairs of opposing resilient flanges which capture and laterally position said opposite side edge flanges.

4. The reflector as set forth in claim 1 wherein said plurality of segments include corrugations that strengthen said plurality of segments, said corrugations defining multiple elongate facets on said inner reflective surfaces, said elongate facets being characterized by reflective surfaces that reflect light emitted from the light source at complex angles to the light source so that light is reflective away from the light source and not reflective back into the light source, and adjacent ones of said elongate facets reflecting light on opposite sides of said central axis.

5. The reflector as set forth in claim 4 wherein said plurality of segments are made from material having a thickness no greater than 0.20 inches.

6. The reflector as set forth in claim 5 wherein said material is sheet aluminum.

7. The reflector as set forth in claim 4 wherein said material is metal and said plurality of segments are formed by stamping.

8. The reflector as set forth in claim 7 including a polycoat on said reflective surfaces that protects said reflective surfaces during stamping.

9. The reflector as set forth in claim 1 wherein said plurality of segments are of at least eight in number to facilitate manufacture, but are stackable for compact shipping and storage.

10. The reflector as set forth in claim 1 including a protective cover for said outlet opening, and wherein each of said bottom edges of said plurality of segments includes an inwardly facing integral bottom flange adapted to retainably engage said protective cover.

11. The reflector as set forth in claim 10 including a gasket, and wherein said protective cover includes a marginal edge that cooperates with said gasket to sealingly engage said inwardly facing integral bottom flanges.

12. A reflector for a luminaire, comprising:

a plurality of segments each having side edges with flanges thereon, a top edge with a flange thereon, a bottom edge, and a reflective inner surface, said plurality of segments being arranged to form a geometrically-shaped hollow shell with said bottom edges arranged to form an outlet opening at one end for emitting light therethrough, said geometrically-shaped hollow shell defining a central axis;

collar means for positioning and retaining said reflector to a light source on said central axis relative to said reflective inner surface, said collar means including a top collar with means for attaching to said top edge flanges; and interconnecting means for interconnecting said flanges of said side edges, said interconnecting means including a plurality of extrusions each removably engaging the opposite flanges on adjacent side edges of said segments so as to orient said reflective inner surfaces of said segments relative to each other, whereby said plurality of segments can be shipped and stored in an unassembled state and assembled and repaired on site.

13. The reflector as set forth in claim 12 including a plurality of different top collars adapting said reflector to attach to different existing light sources.

14. The reflector as set forth in claim 12 wherein said top collar includes two semicircular members that join to form a ring.

15. A reflector for a luminaire, comprising:

a plurality of segments each having side edges with flanges thereon, a top edge with a flange thereon, a bottom edge, and a reflective inner surface, said plurality of segments being arranged to form a geometrically shaped hollow shell with said bottom edges arranged to form an outlet opening at one end for emitting light therethrough, said geometrically-shaped hollow shell defining a central axis;

collar means for positioning and retaining said reflector to a light source on said central axis relative to said reflective inner surfaces, said collar means including a top collar with means for attaching to said flanges of said top edges;

interconnecting means for interconnecting said flanges of said side edges, said interconnecting means including a plurality of extrusions each removably engages the opposite flanges on adjacent side edges of said segments so as to orient said reflective inner surfaces of said segments relative to each other, whereby said plurality of segments can be shipped and stored in an unassembled state and assembled and repaired on site;

a protective cover for said outlet opening, and wherein each of said bottom edges of said plurality of segments includes an inwardly facing integral bottom flange adapted to retainably engage said protective cover;

a gasket, and wherein said protective cover includes a marginal edge that cooperates with said gasket to sealingly engage said inwardly facing integral bottom flanges; and said collar means sealingly engaging said top edges flanges and said extrusions sealingly engaging said opposite side edge flanges, said collar means, said extrusions and said bottom flanges forming a substantially air tight and environmentally resistant enclosure for said light source.

16. A reflector for a luminaire, comprising:

a plurality of segments each having side edges with flanges thereon, at op edge with a flange thereon, a bottom edge, and a reflective inner surface, said plurality of segments being arranged to form a geometrically shaped hollow shell with said bottom edges arranged to form an outlet opening at one end for emitting light therethrough, said geometrically-shaped hollow shell defining a central axis;

collar means for positioning and retaining said reflector to a light source on said central axis relative to said reflective inner surfaces, said collar means including a top collar with means for attaching to said flanges of said top edges;

interconnecting means for interconnecting said flanges of said side edges, said interconnecting means including a plurality of extrusions each removably engages the opposite flanges on adjacent side edges of said segments so as to orient said reflective inner surfaces of said segments relative to each other, whereby said plurality of segments can be shipped and stored in an unassembled state and assembled and repaired on site;

said removable extrusion being translucent so as to transmit an amount of light therethrough to provide an appearance signature.

17. A reflector for a luminaire, comprising:

a plurality of segments each having side edges with flanges thereon, a top edge with a flange thereon, a bottom edge, and a reflective inner surface, said plurality of segments being arranged to form a geometrically shaped hollow shell with said bottom edges arranged to form an outlet opening at one end for emitting light therethrough, said geometrically-shaped hollow shell defining a central axis;

collar means for positioning and retaining said reflector to a light source on said central axis relative to said reflective inner surfaces, said collar means including a top collar with means for attaching to said flanges of said top edges;

interconnecting means for interconnecting said flanges of said side edges, said interconnecting means including a plurality of extrusions each removably engages the opposite side edges of said segments so as to orient said reflective inner surfaces of said segments relative to each other, whereby said plurality of segments can be shipped and stored in an unassembled state and assembled and repaired on site; and said plurality of segments including a plurality of differently shaped segments, wherein various of said plurality of differently shaped segments can be selected and arranged so as to form a unique reflector that creates a particular desired pattern of reflected light therebelow.

18. The reflector as set forth in claim 17 wherein said plurality differently shaped segments include first segments adapted to reflect light in an arcuate pattern such as to illuminate a circular floor area, second segments adapted to reflect light in a pattern with a corner such as to illuminate a rectangular floor area, and third segments adapted to reflect light at an obtuse lateral angle such as to illuminate a wall of racks.

19. A reflector for a luminaire, comprising:

a plurality of segments each having side edges, a top edge with a flange thereon, a bottom edge, and a reflective inner surface, said plurality of segments being arranged to form a geometrically shaped hollow shell with said bottom edges arranged to form an outlet opening at one end for emitting light therethrough, said geometrically-shaped hollow shell defining a central axis;

a removable top collar attached to said flanges on said top edges and including means for positioning and retaining said reflector to a light source on said central axis relative to said reflective inner surfaces, whereby said removable top collar can be attached on site; and interconnecting means including a plurality of extrusions for interconnecting said plurality of segments so as to orient said reflective inner surfaces relative to the light source and each other, said plurality of extrusions each removably engaging said flanges on adjacent side edges of said segments to retain said segments against said extrusion.

20. The reflector as set forth in claim 19 wherein said top collar includes two semicircular members that join to form a ring.

21. The reflector as set forth in claim 19 wherein said top collar is adapted to sealingly engage said plurality of segments and the light source to provide a weather resistant covering over the light source.

22. The reflector as set forth in claim 21 including a protective cover for said outlet opening, and wherein each of said bottom edges of said plurality of segments includes, an inwardly facing bottom flange adapted to retainably engage said protective cover, said inwardly facing bottom flange sealingly engaging said protective cover, whereby said reflector encloses the light source in a weather resistant enclosure.

23. The reflector as set forth in claim 19 wherein said plurality of segments include corrugations that strengthen said plurality of segments, said corrugations defining multiple elongate facets on said inner reflective surfaces said elongate facets being characterized by reflective surfaces that reflect light emitted from the light source at complex angles to the light source so that light is reflected away from the light source and not reflected back into the light source, and adjacent ones of said elongate facets reflecting light on opposite sides of said central axis.

24. The reflector as set forth in claim 23 wherein said plurality of segments are made from material having a thickness no greater than 0.020 inches.

25. The reflector as set forth in claim 24 wherein said material is sheet aluminum.

26. The reflector as set forth in claim 24 wherein said material is metal and said plurality of segments are formed by stamping.

27. The reflector as set forth in claim 19 including a plurality of differently shaped segments, wherein various of said plurality of differently shaped segments can be selected and arranged so as t form a unique reflector that creates a particular desired pattern of reflected light therebelow, said plurality of differently shaped segments including first segments adapted to reflect light in an arcuate pattern such as to illuminate a circular floor area, second segments adapted to reflect light in a square pattern such as to illuminate a rectangular floor area, and third segments adapted to reflect light at an obtuse lateral angle such as to illuminate a wall of racks.

28. A reflector for a luminaire, comprising:

a plurality of segments each having side edges, a top edge with a flange thereon, a bottom edge, and a reflective inner surface, said plurality of segments being arranged to form a geometrically-shaped hollow shell with said bottom edges arranged to form an outlet opening at one end for emitting light therethrough, said geometrically-shaped hollow shell defining a central axis;

a plurality of different top collars adapting said reflector to attach to different existing light sources, a selected one of said top collars being attached to said flanges on said top edges and including means for positioning and retaining said reflector to a light source on said central axis relative to said reflective inner surfaces, whereby said selected top collar can be attached on site; and interconnecting means for interconnecting said plurality of segments so as to orient said reflective inner surfaces relative to the light source and each other.

29. A reflector for a luminaire, comprising:

a plurality of segments each having side edges, a top edge, a bottom edge, and a reflective inner surface, said segments being arranged to form a geometrically shaped hollow shell with said bottom edges arranged to form an outlet opening at one end for emitting light therethrough, said bottom edge including an inwardly facing integral bottom flange, said hollow shell defining a central axis;

collar means for positioning and retaining said reflector to a light source on said central axis relative to said reflective inner surfaces;

interconnecting means located along said side edges of said segments;

a plurality of connectors each including means for removably securely engaging the opposite interconnecting means on adjacent side edges of said segments for interconnecting said segments so as to orient said reflective inner surfaces relative to the light source and each other; and a cover for covering said outlet opening including a marginal edge, said integral bottom flanges on said segments extending inwardly and being adapted to engage said marginal edge under said marginal edge to secure said cover over said outlet opening.

30. The reflector as set forth in claim 29 wherein said cover is transparent and including a gasket adapted to cooperate with said inwardly facing integral bottom flanges to sealingly engage said cover.

31. The reflector as set forth in claim 29 wherein said cover is a grate having openings therein.

32. The reflector as set forth in claim 29 wherein said cover is a wire mesh.

* * * * *

UNITED STATES PATENT AND TRADEMARK OFFICE

CERTIFICATE OF CORRECTION

PATENT NO. : 5,287,259

DATED : February 15, 1994

INVENTOR(S) : Terry L. Lautzenheiser

It is certified that error appears in the above-indentified patent and that said Letters Patent is hereby corrected as shown below:

Column 3, line 68
After "cover" delete —54'—.

Column 8, line 68, claim 5;
"0.20" should be —0.020—.

Column 10, line 27, claim 16;
"at op" should be —a top—.

Column 12, line 14, claim 27;
"t form" should be —to form—.

Signed and Sealed this

Thirteenth Day of September, 1994

Bruce Lehman

*Attest:*

BRUCE LEHMAN

*Attesting Officer*

*Commissioner of Patents and Trademarks*